United States Patent [19]

Timmer

[11] 4,159,161

[45] Jun. 26, 1979

[54] TERMINAL CLAMP

[76] Inventor: Henry Timmer, 2705 Rockhill Dr., Grand Rapids, Mich. 49505

[21] Appl. No.: 881,782

[22] Filed: Feb. 27, 1978

Related U.S. Application Data

[63] Continuation-in-part of Ser. No. 760,736, Jan. 19, 1977, Pat. No. 4,083,624.

[51] Int. Cl.[2] ..... H01R 11/10

[52] U.S. Cl. ..... 339/264 R; 269/284; 339/31 R; 339/95 R

[58] Field of Search ..... 339/31 R, 95 R, 264; 269/284

[56] References Cited

U.S. PATENT DOCUMENTS

| | | | |
|---|---|---|---|
| 1,810,901 | 6/1931 | Bormann et al. | 339/264 R |
| 2,565,999 | 8/1951 | Teglas et al. | 269/284 |
| 3,403,901 | 10/1968 | Servadio | 269/284 |
| 4,040,714 | 8/1977 | Grover et al. | 339/264 R |

*Primary Examiner*—Joseph H. McGlynn
*Attorney, Agent, or Firm*—Glenn B. Morse

[57] ABSTRACT

A C-clamp has a bearing pad at one end of the C-shaped frame configuration, and another bearing pad on a clamping shaft moveable axially in the other end of the frame. A replaceable force-transfer member interengages with one of the pads, and is preferably held in place with a spring-loaded detent.

1 Claim, 11 Drawing Figures

TERMINAL CLAMP

BACKGROUND OF THE INVENTION

This application is a continuation-in-part of Application Ser. No. 760,736, filed on Jan. 19, 1977, now U.S. Pat. No. 4,083,624.

So-called C-clamps have been in use since ancient times. The usual modern form of the device involves a C-shaped frame, with some form of a bearing pad formed or mounted at one extremity of the frame. The opposite extremity will usually have a clamping rod moveably mounted in a direction toward and away from the pad to generate clamping pressure. This rod is often threaded along its entire length, but one known modification has a rapid-traverse arrangement in which the rod is slideably mounted in a collar having threaded engagement with the frame. This form of the unit will have a one-way rotative interlock between the shaft and the threaded collar such that rotation in this direction corresponds to movement of the collar in the thread system to carry the shaft toward the pressure pad.

The C-clamp has been applied to a somewhat different field of use relatively recently. In electrical welding procedures, it is necessary to provide a return path for the current from the piece being welded to the welding generator. This has sometimes been accomplished by simply applying a C-clamp to the welded piece, with a cable terminal entrapped under grip of the C-clamp so that the terminal bears solidly against the welded member. Sometimes the clamp is used to hold a couple of members being welded together, while serving the additional function of securing the cable terminal in position to receive the return current.

SUMMARY OF THE INVENTION

The traditional form of the C-clamp is modified by the present invention through the provision of a force-transfer member (preferably one selected from a plurality of these) that are interengagable with one of the bearing pads to provide selected surface characteristics for engaging the clamped objects. In the preferred form of the invention, the force-transfer member has a socket-shaped recess receiving the bearing pad associated with the adjustable clamping rod, and is held in position by a spring-loaded detent engagable with a peripheral groove in the otherwise standard pressure pad. This arrangement is particularly significant in clamps that are used as terminals for cables conducting welding current, and the surface configuration of the force-transfer member can be designed to provide either non-slip characteristics, or may be intended primarily to provide a multiplicity of contact points. In the latter case, it may occasionally be desirable to attach the force-transfer member to the fixed pressure pad of the standard C-clamp for more direct electrical connection to the cable terminal.

DESCRIPTION OF THE PREFERRED EMBODIMENTS

Figure 2:
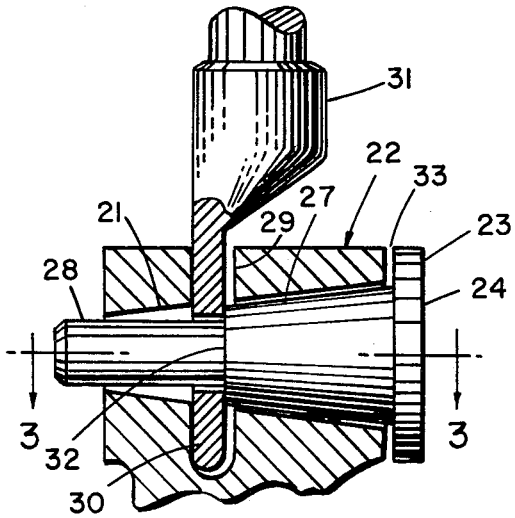
FIG. 2 is a section on the plane 2—2 of FIG. 3.
Figure 3:
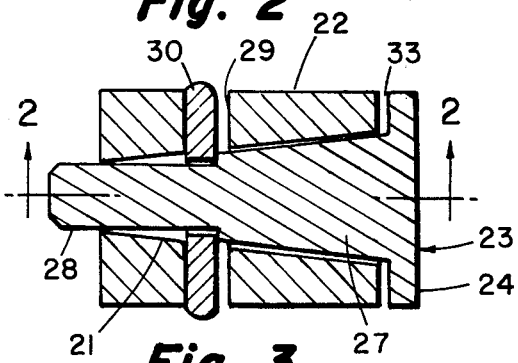
FIG. 3 is a section on the plane 3—3 of FIG. 1.

Referring to Sheet 1 of the drawings, the frame 20 of the C-clamp has a bore 21 in the extremity 22 receiving the plug 23, which provides the head 24 functioning as a bearing pressure pad transferring force applied by the clamping rod 25 through the articulating pressure foot 26 forming a second bearing pad. The plug 23 has a body portion 27 traversing the bore 21, with the extension 28 continuing beyond the extremity 22 of the frame so that the plug can be struck at that end to knock it to the right, as shown in FIGS. 2 and 3, for disengaging the plug from its assembled position. A slot 29 in extremity 22 intersects the bore 21, and provides for the insertion of the end 30 of the conventional cable connector 31. Movement of the plug 23 to the right to a sufficient degree that it does not intersect the slot 29 will obviously free the connector 31 from engagement with the clamp.

Figure 4:
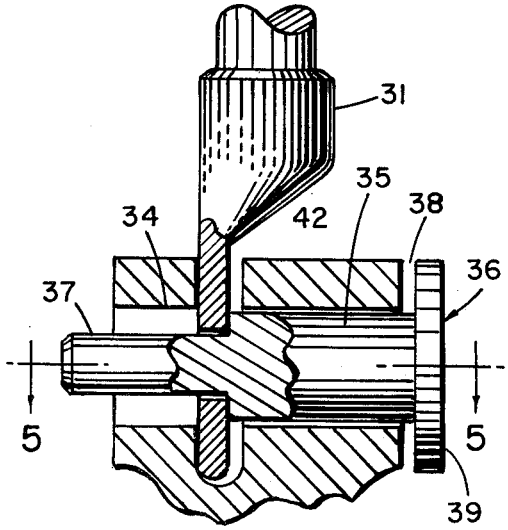
FIG. 4 is a section corresponding to FIG. 3, but illustrating a modified form of the invention.

The body portion 27 is provided with a shoulder 32 normally bearing directly on the portion 30 of the connector for the direct transfer of clamping pressure at this point to generate the best possible electrical conductivity. A degree of clearance is provided under the head 24, as shown at 33, to assure this relationship. In the absence of the connector 31, the tapered configuration of the bore 21 is provided to give the most solid locating relationship between the plug and the clamp frame. Under these circumstances, it is preferable that the bearing pressure be transferred at the tapered body portion, with some degree of clearance still remaining at 33. FIG. 4 shows a modified form of the invention in which the bore 34 is cylindrical, with the body portion 35 of the plug 36 being provided with slip-fit clearance within this bore. The advantage of this arrangement centers primarily in the manufacturing processes involved, as the provision of a tapered bore as shown in FIGS. 2 and 3 requires the insertion of reaming devices within the gap of the C-clamp, and the subsequent coupling of them to a driving mechanism capable of engaging the reamer after it has been slipped through the rough opening which will later become the bore 21. In FIG. 4, the entire formation of the bore 34 can take place from the left. The clearances and proportions of the components are selected to assure that clamping pressure is directly applied to the connector 31 by the body portion of the plug. The length of the extension 37 is sufficient to provide the knock-out feature previously discussed. In the FIG. 4 arrangement, the clearance at 38 will disappear on removal of the cable connector 31, so that clamping pressure is transferred at the underside of the head 39 of the plug 36.

Figure 5:
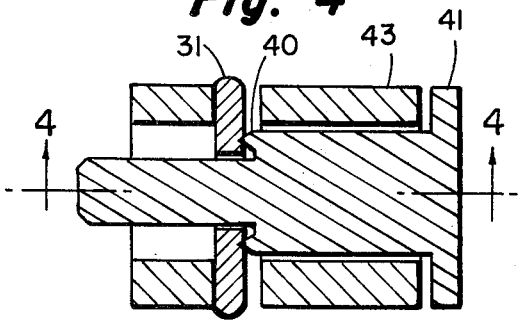
FIG. 5 is a section on the plane 5—5 of FIG. 4.

FIG. 5 is similar to FIG. 4, with the exception that the shoulder 40 of the plug 41 is in the form of an annular ridge that is triangular in cross-section, in order to give a solid bite on the cable connector 31. It is common knowledge that the copper-alloy materials normally used for the connector 31 have a tendency to develop a coating of copper oxide on the surface, which has a relatively high electrical resistance. The configuration shown in FIG. 5 will have a tendency to scratch through this coating, and thus generate the best contact conditions. The clamp frames 42 and 43 appearing in FIGS. 4 and 5, respectively, are otherwise similar to the frame 20 of FIG. 1.

Figure 1:
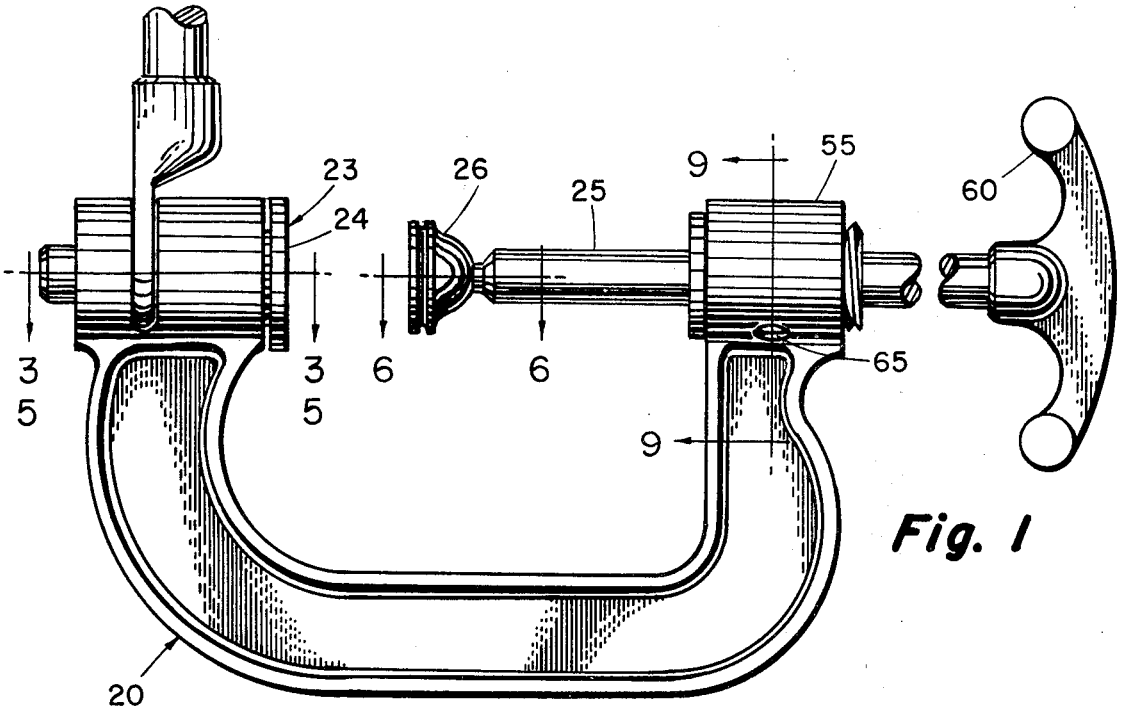
FIG. 1 is a plan view showing a terminal clamp incorporating the present invention, with a cable terminal in the engaged position.
Figure 6:
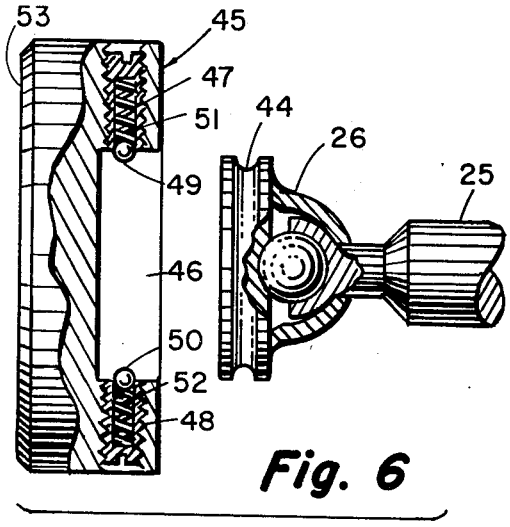
FIG. 6 is an exploded view on an enlarged scale showing an attachment to the clamping foot of the device.
Figure 7:
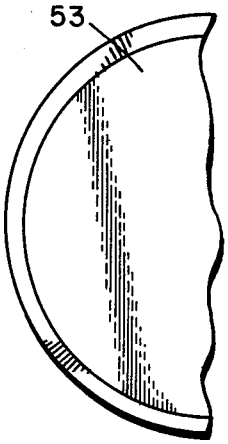
FIGS. 7 and 8 show alternative surface configurations for the bearing face of the attachment illustrated in FIG. 6.
Figure 8:
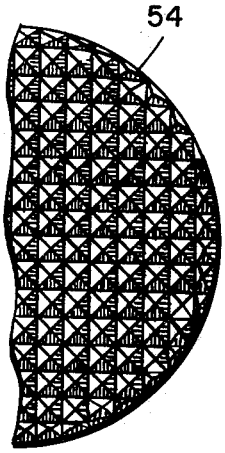

Referring to Sheet 2 of the drawings, FIG. 6 illustrates a removable force-transfer attachment for the articulating clamping foot 26 appearing in FIG. 1. This member is grooved peripherally as shown at 44. The bearing attachment 45 has a counterbore 46 capable of receiving the outside diameter of the pressure foot 26, and opposite sides of the attachment 45 are provided with devices commonly known to tool and die makers as "breakers" indicated at 47 and 48. These are essentially set-screw type units received in threaded holes in the attachment 45, as shown, and containing moveable balls 49 and 50 biased outwardly to the position shown in FIG. 6 by internal compression springs 51 and 52, respectively. These units are conventional. FIG. 7 shows a form of attachment 45 in which the bearing surface 53 is coplanar, and FIG. 8 illustrates a cross-serrated pattern 54 providing for an increased gripping action where surface conditions are such that the marking is not a problem. This configuration can be usable either for its non-slip characteristics, or to provide a multiplicity of contact points for the transfer of electrical current. In the latter case, it may be desirable to mount the force-transfer member 54 on the pressure pad 24 providing the fixed bearing pad of the clamp. The periphery of the head would then be provided with a groove similar to the groove 44 appearing in FIG. 6. The counterbore 46 providing the socket receiving the clamping pad would of course be provided with the diameter appropriate for the diameter of the pressure pad 24.

Figure 9:
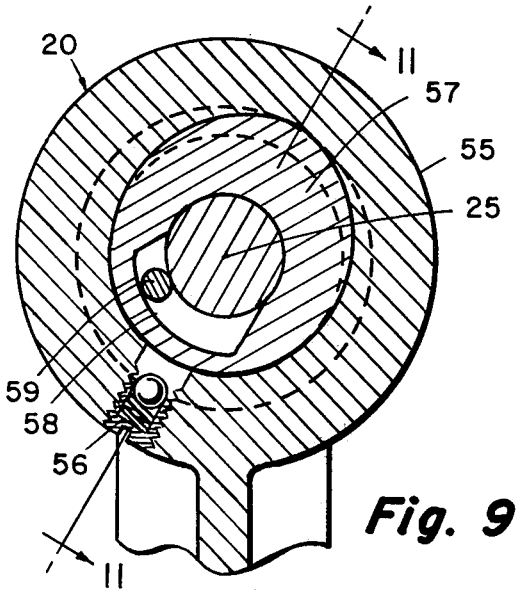
FIG. 9 is a section on the plane 9—9 of FIG. 1, on an enlarged scale.
Figure 10:
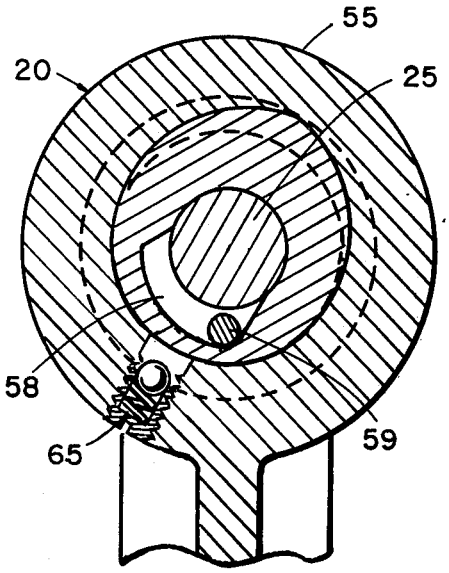
FIG. 10 is similar to FIG. 9, but showing the rotative interlock in a free position.
Figure 11:
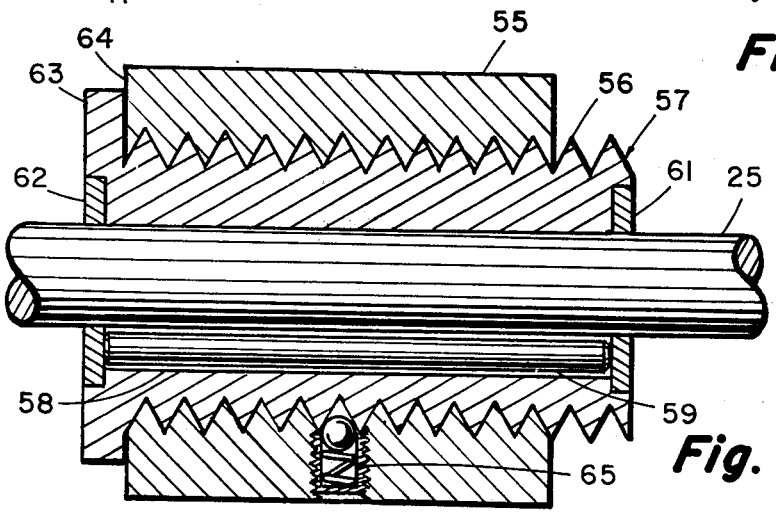
FIG. 11 is a section on the plane 11—11 of FIG. 9.

Referring to FIGS. 9–11, the extremity 55 of the clamp frame 20 opposite from the pressure pad 24 is provided with a threaded bore receiving the threaded exterior 56 of the tubular member 57. This member has a central passage slideably receiving the pressure shaft 25, and having a lateral extension forming a cam surface indicated at 58 which entraps the locking roller 59 on clockwise rotation of the shaft 25 with respect to the frame, as viewed in FIG. 9. The resulting frictional interlock of this arrangement is discussed in the Burbank, et al. U.S. Pat. No. 2,396,823, and results in the rotation of the tubular member 57 with the shaft 25 under torque applied to the handle 60. Opposite (counterclockwise, as shown in FIG. 10) relative rotation between the shaft 25 and the frame 20 will result in placement of the components in a position where the roller 59 is no longer in jamming relationship between the shaft 25 and the cam surface 58, thus leaving the shaft free to slide within the tubular member 57 to affect rapid-traverse and disengagement of the clamp, and also provide for quick re-engagement with another member. The cam surface 58, and also the cylindrical surface receiving the shaft 25, are preferably provided by a broaching operation establishing these surfaces throughout the length of the member 57. To confine the roller 59, it is preferable to insert end washers as shown at 61 and 62, which are pressed into appropriate recesses in the ends of the tubular member 57.

To avoid the necessity of having to bring the assembly fully to the FIG. 11 position, where the end flange 63 on the tubular member 57 engages the surface 64 of the frame in order to affect disengagement of the rotative interlock, the brake unit shown at 65 is incorporated at the position shown in FIG. 1. This unit is preferably the same type as that discussed in connection with FIG. 6. The screw configuration provides a convenient degree of adjustability of the drag resulting from the engagement of the ball end with the thread grooves, in the relationship shown in FIG. 11. The adjustment should provide a sufficient degree of drag to assure that back rotation of the handle 60 will first result in disengagement of the jamming action illustrated in FIG. 9. Since the threaded member 57 is thus not normally back-rotated to the FIG. 11 position by the handle 60, it may be desirable to apply knurling to the outer periphery of the flange 63 so that it can be manipulated directly by hand, when necessary.

I claim:

1. An electrical terminal clamp having a C-shaped frame, and having a first bearing pad mounted at one extremity of said frame on the side thereof nearest the opposite extremity of said frame, and also having a clamping shaft mounted at said opposite extremity for movement toward and away from said first pad, said shaft having means forming a second bearing pad, said second bearing pad having freedom for rotation and angular articulation with respect to said shaft, wherein the improvement comprises:

a replaceable force-transfer member having a socket receiving said second bearing pad, and interposed between said first and second bearing pads to provide a selected contact surface configuration for application of clamping forces, said second bearing pad having a peripheral discontinuity, and said force-transfer member having a detent engageable with said discontinuity.

* * * * *